US005617074A

United States Patent [19]

White

[11] Patent Number: 5,617,074

[45] Date of Patent: Apr. 1, 1997

[54] CHILD FINDER

[76] Inventor: Marvin D. White, 175 Telegraph Rd., Stafford, Va. 22554

[21] Appl. No.: 552,336

[22] Filed: Nov. 2, 1995

[51] Int. Cl.[6] ..... G08B 23/00

[52] U.S. Cl. ..... 340/573; 340/539; 340/574; 455/100; 200/532

[58] Field of Search ..... 340/573, 574, 340/539; 455/100; 200/532, 520

[56] References Cited

U.S. PATENT DOCUMENTS

| | | | |
|---|---|---|---|
| 4,063,410 | 12/1977 | Welling | 340/573 X |
| 4,591,836 | 5/1986 | Feigenblatt, Jr. et al. | 340/574 |
| 4,694,284 | 9/1987 | Leveille et al. | 340/574 |
| 4,736,196 | 4/1988 | McMahon et al. | 340/573 |
| 5,223,818 | 6/1993 | Polo | 340/574 |

FOREIGN PATENT DOCUMENTS

| | | | |
|---|---|---|---|
| 2539983 | 8/1984 | France | 340/573 |
| 2725449 | 12/1978 | Germany | 455/100 |

*Primary Examiner*—Thomas Mullen

[57] ABSTRACT

A child finder basically consists of a transmitter which is concealingly attachable to a child's body and which sends a signal to a conventional receiver so that the child's location can be continually monitored. The transmitter will typically be carried in an article of jewelry, such as a watch, bracelet, ring, or the like, and will use a special on/off switch which allows the transmitter to be activated only when the jewelry is being worn by the child. The switch includes a reciprocal push button which closes the transmitter's electrical circuit when depressed, and the button is spring-biasedly moved away from electrical contact with the transmitter's circuit when the article of jewelry is not being worn. To protect against inadvertent partial movement of the button which could break electrical contact thus deactivating the transmitter an electrical contact surface of the button is provided with an upwardly extending electrically conductive spring finger which maintains continual electrical contact irrespective of temporary and inadvertent reciprocal movement of the push button. When the push button is totally depressed, the spring finger recedes into a provided groove on the electrical contact surface of the button so as to prevent the finger from causing interference between the primary electrical contact surfaces.

3 Claims, 3 Drawing Sheets

CHILD FINDER

BACKGROUND OF THE INVENTION

1. Field of the Invention

The present invention relates to people monitoring devices and more particularly pertains to a child finder which utilizes a transmitter and receiver arrangement.

2. Description of the Prior Art

The use of electronic child monitors and locators is well known in the prior art. This is evidenced by the granting of a number of patents relating to various functional and structural aspects of such monitoring devices. These electronic monitoring devices typically utilize a transmitter mounted to the body of a person to be monitored, and a remotely located receiver which continually receives a signal from the aforementioned transmitter. A good example of such a locator system is to be found in U.S. Pat. No. 5,021,794 which issued to Lawrence on Jun. 4, 1991. In this patent, there is disclosed a radio transmitter in a miniaturized configuration which is designed to be concealed on a person to be located, such as a lost child. An initiating signal is automatically transmitted by a repeater station when desired so as to activate the transmitter and allow the child to be located.

Another typical example of a personal locator is to be found in U.S. Pat. No. 3,806,936 which issued to Koster on Apr. 23, 1974. The device illustrated and discussed in this patent comprises a tone modulated transmitter designed to transmit emergency distress signals, and these signals can be received by a receiver so as to determine the direction from which the emergency signals are being transmitted. The locator is small enough to be carried in a pocket or connected to the belt of a user.

An even further example of a personal locator transmitter is shown in U.S. Pat. No. 5,014,040 which issued to Weaver et al. on May 7, 1991. The personal locator transmitter discussed in this patent is adapted to be worn on the wrist of a user, and it has the size and appearance of a conventional wrist watch. The watch includes both a manually operable alarm activated by pressing a button and an automatic alarm actuated by an attempt to remove the unit from the wrist of the wearer.

While each of these prior art patents disclose devices which will fulfill their respective particular objects and requirements and which are most likely quite functional for their intended purposes, it will be noted that none of these patents disclose a concealed transmitter arrangement which is automatically electrically activated when worn on the body of a user. To the contrary, the prior art typically illustrates devices which are continually electrically activated through the use of batteries and which are not designed to be automatically activated only during periods of use. Accordingly, there is the danger that electrical energy will be depleted to the extent that the batteries will fail, especially if a user of such a locator forgets to turn off the electrical power supply to the transmitter during periods of non-use. As such, there apparently still exists the need for these types of concealed transmitters wherein the electrical supplies which power them are automatically turned on during periods of use and similarly automatically turned off during periods of non-use. In this respect, the present invention substantially fulfills this need.

SUMMARY OF THE INVENTION

In view of the foregoing disadvantages inherent in the known types of child finders now present in the prior art, the present invention provides a new child finder wherein the same can be utilized to continually monitor the location and movement of a child. As such, the general purpose of the present invention, which will be described subsequently in greater detail, is to provide a child finder and method which has many of the advantages of the child finders mentioned heretofore and many additional novel features that result in a child finder which is not anticipated, rendered obvious, suggested, or even implied by any of the prior art child finders, either alone or in any combination thereof.

To attain this, the present invention generally comprises a child finder which basically consists of a transmitter that is concealingly attachable to a child's body and which sends a signal to a conventional receiver so that the child's location can be continually monitored. The transmitter will typically be carried in an article of jewelry, such as watch, bracelet, ring, or the like, and will use a special on/off switch which allows the transmitter to be activated only when the jewelry is being worn by the child. The switch includes a reciprocal push button which closes the transmitter's electrical circuit when depressed, and the button is spring-biasedly moved away from electrical contact with the transmitter's circuit when the article of jewelry is not being worn. To protect against inadvertent partial movement of the button which could break electrical contact thus deactivating the transmitter an electrical contact surface of the button is provided with an upwardly extending electrically conductive spring finger which maintains continual electrical contact irrespective of temporary and inadvertent reciprocal movement of the push button. When the push button is totally depressed, the spring finger recedes into a provided groove on the electrical contact surface of the button so as to prevent the finger from causing interference between the primary electrical contact surfaces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child finder and method of use which has many of the advantages of the child finders mentioned heretofore and many novel features that result in a child finder which is not anticipated, rendered obvious, suggested, or even implied by any of the prior art child finders, either alone or in any combination thereof.

It is another object of the present invention to provide a new child finder which may be easily and efficiently manufactured and marketed.

It is a further object of the present invention to provide a new child finder which is of a durable and reliable construction.

An even further object of the present invention is to provide a new child finder which is susceptible of a low cost of manufacture with regard to both materials and labor, and which accordingly is then susceptible of low prices of sale to the consuming public, thereby making such child finders economically available to the buying public.

Still yet another object of the present invention is to provide a new child finder which provides in the apparatuses and methods of the prior art some of the advantages thereof, while simultaneously overcoming some of the disadvantages normally associated therewith.

Still another object of the present invention is to provide a new and improved child finder which facilitates the use of an automatically activated power supply.

Yet another object of the present invention is to provide a new and improved child finder which eliminates the danger of battery power failure due to the use of such batteries during periods of transmitter non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
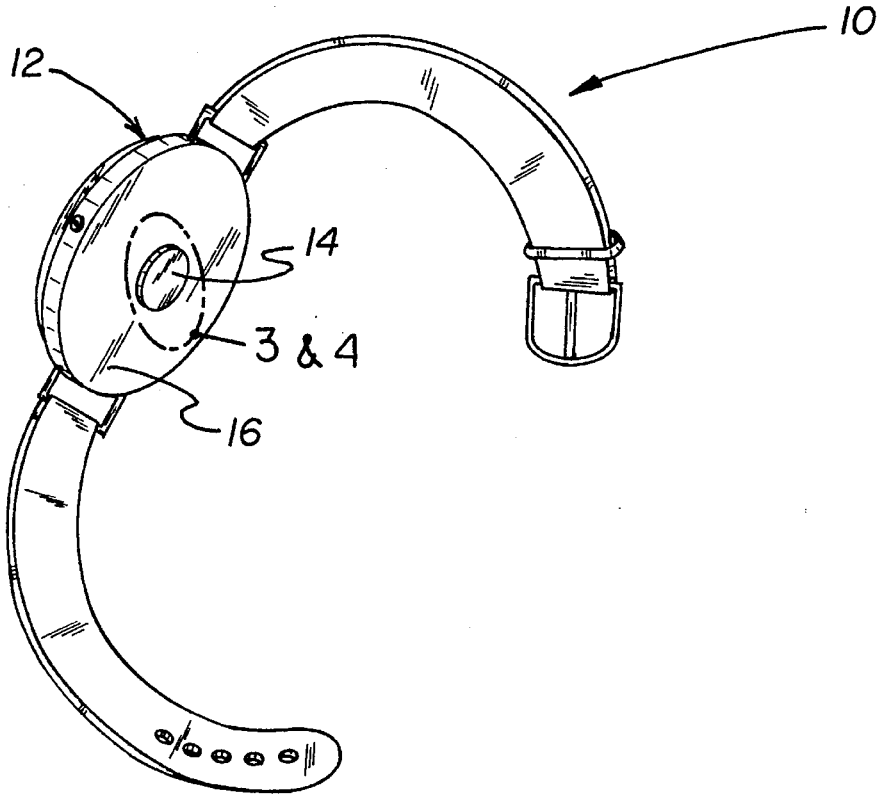
FIG. 1 is a perspective view of one preferred embodiment of the child finder embodying the principals and concepts of the present invention.
Figure 2:
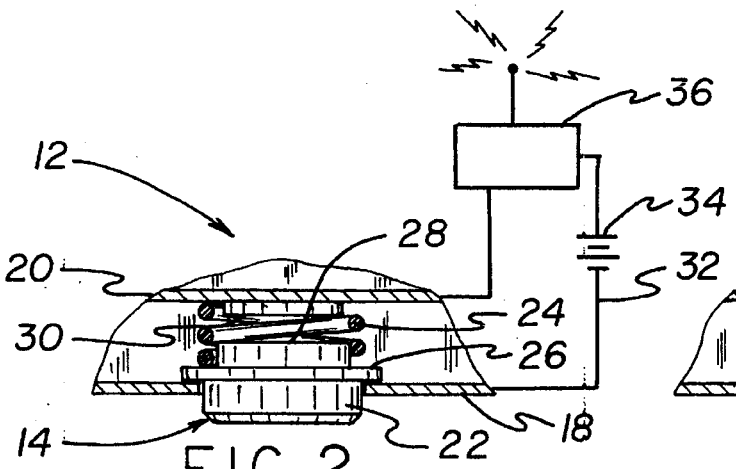
FIG. 2 is a partial cross-sectional view of the automatic operating switch forming a part of the present invention wherein such switch is in an opened condition.
Figure 3:
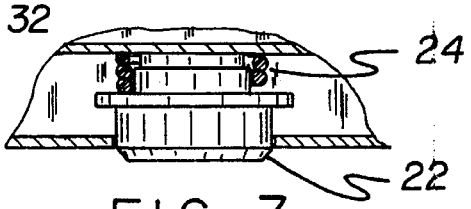
FIG. 3 is a partial cross-sectional view of the switch showing the same in a closed condition.

With reference now to the drawings, and in particular to FIGS. 1–3 thereof, a new child finder embodying the principles and concepts of the present invention and generally designated by the reference numeral 10 will be described.

More specifically, it will be noted that the child finder 10, in the embodiment shown in FIG. 1, is concealingly mounted within a conventional wrist watch 12 and employs an on/off activation switch 14 mounted on a bottom surface 16 of the watch. While the child finder transmitter 10 is concealed in a watch 12 in this embodiment, it is to be understood that virtually any form or type of jewelry could be utilized to similarly conceal a transmitter, to include bracelets, necklaces, rings, etc. As such, all types of jewelry and other body worn decorative or utilitarian devices are within the intent and purview of the present invention, and all such devices are intended to be encompassed by the language of the claims appended hereto.

FIG. 2 of the drawings particularly illustrates novel details of the activation switch 14 which is also shown in FIGS. 1 and 3. In this respect, the watch 12 will include an outer casing 18 which is formed of a first electrically conductive material and an inner casing 20 which is also formed of an electrically conductive material and which is normally insulated from the outer case whereby no electrical communication exists therebetween.

Figure 7:
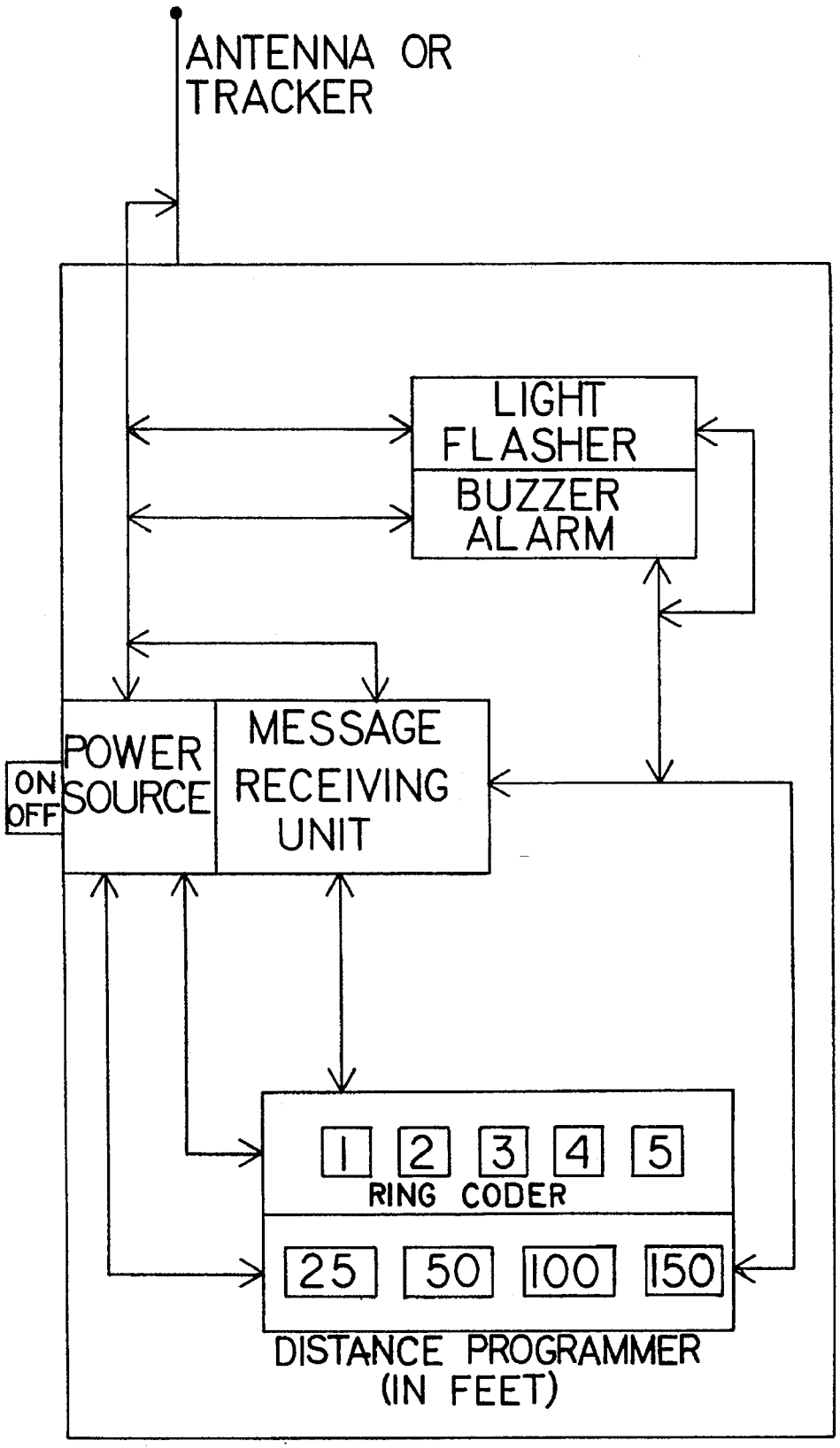
FIG. 7 is an electrical diagram illustrating a typical receiver unit which could be utilized with present invention.

The switch 14 further includes a cylindrically shaped push button 22 which is formed from an electrically conductive material and which is normally in an outer protruding position, as illustrated in FIG. 2, due to the spring biasing force supplied by a non-electrically conductive compression spring 24 positioned between the inner casing 20 and a lip 26 forming a part of the push button 22. The push button 22 is also provided with a flat electrical contact surface 28 which is abuttable with a second electrical contact surface 30 that is in electrical communication with the inner casing 20. When the electrical contact surfaces 28, 30 are not in electrical communication, an electrical circuit 32 is open whereby no electrical power is delivered from a battery 34 to a miniaturized emergency transmitter 36 concealed within the watch 12. When the push button 22 is depressed, as shown in FIG. 3 and as occasioned by a wearing of the watch 12 around the wrist of a child, the spring 24 is compressed whereby the electrical contact surfaces 28, 30 are brought into electrical communication, thereby closing the electrical circuit 32 and activating the miniature transmitter 36. The miniature transmitter 36 can then continually transmit a monitoring signal to a conventional receiver circuit, an example of which is illustrated in FIG. 7. As such, the transmitter 36 receives electrical power only during those times that the watch 12 is being worn by a child. When the child is not being monitored, the watch can be removed from the child's wrist and electrical power to the miniature transmitter 36 will automatically be shut off, thereby conserving the energy of the battery 34 until it is again needed.

Figure 4:
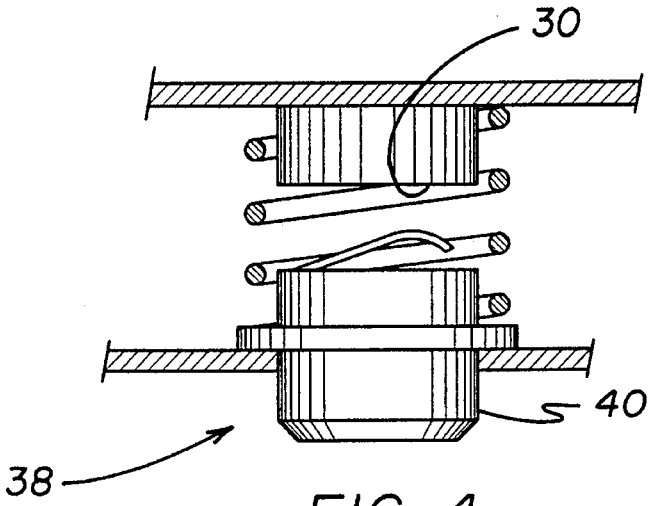
FIG. 4 is a partial cross-sectional view of a modified embodiment of the switch showing the same in an open position.
Figure 5:
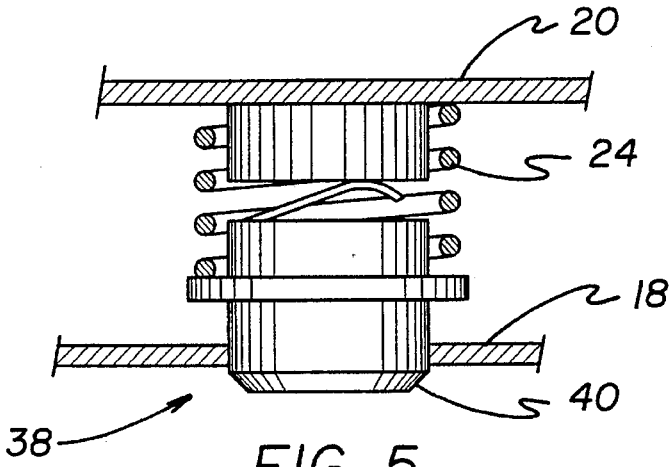
FIG. 5 is a partial cross-sectional view of the switch in FIG. 4 wherein the same is in an partially closed condition.
Figure 6:
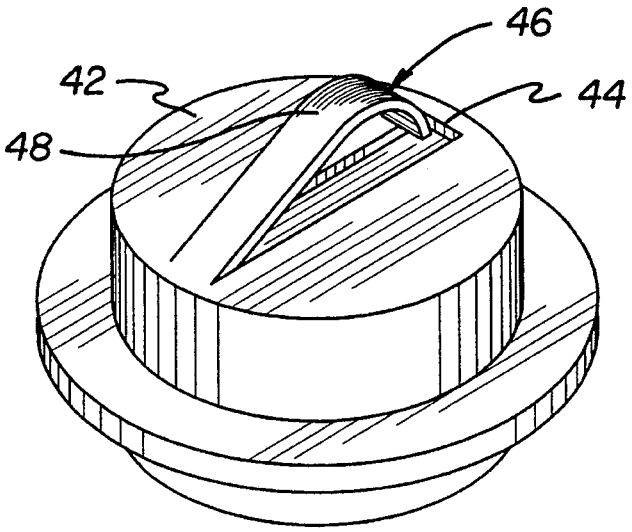
FIG. 6 is a perspective view of the second embodiment of switch illustrated in FIG. 4.

FIGS. 4, 5 and 6 illustrate a second embodiment of activation switch which is designated by the reference numeral 38. Recognizing the fact that the transmitter 36 may be carried in a loosely worn watch 12, the switch 14, as priorly discussed, may slightly protrude outwardly of the casing 18 whereby the electrical contact surfaces 28, 30 temporarily disengage or remain permanently disengaged, thereby resulting in an undesired deactivation of the transmitter 36. To eliminate this eventuality, a modified push button 40 includes an electrical contact surface 42 having a deep groove 44 integrally formed therein. At one end of the groove 44, a flexible metallic spring finger 46, having a curvilinearly shaped upper contact surface 48 may be fixedly secured therein by some conventional means of attachment, such as by welding or the like.

The spring finger 46 is constructed from an electrically conductive material, and it is normally out of contact with the contact surface 30 when the button 40 is in a protruding open circuit position, as best illustrated in FIG. 4. When the watch or other jewelry item is attached to the child's body, the button 40 moves inwardly due to a compression of the spring 24, as shown in FIG. 5, and the spring finger 46 establishes initial electrical contact between the contact surfaces 30, 42. If the push button 40 is pushed totally into the casing 18 so as to have the appearance of the switch arrangement shown in FIG. 3, the spring finger 46 will resiliently move downwardly and be totally contained within the groove 44, thereby to eliminate any danger of interference with the total surface contact between the conductive surfaces 30, 42. However, if the item of jewelry is loosely worn, whereby the compression spring 24 could inadvertently and undesirably cause the push button 40 to move slightly outwardly from the outer casing 18, whereby the electrical contact surfaces 30, 42 become disengaged, no interruption of electrical power to the miniature transmitter 36 will be experienced due to the fact that the spring finger 46 will move upwardly out of the groove 44 and continue to maintain electrical contact between the electrically conductive surfaces 30, 42. The curvilinearly shaped upper surface 48 of the spring finger 46 minimizes frictional contact between the spring finger and the electrically conductive surface 30 as may be occasioned by a continual reciprocal movement of the push button 40, thereby lessening the chances for wear and abrasion to occur between the spring finger and the contact surface 30. This switch embodiment 38 thus assures that continual electrical energy is supplied to the transmitter 36 even if the watch 12 is loosely worn, while at the same time being operable to open the electrical circuit 32 when the watch is removed from the wrist of the child.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A child finder constructed as a watch to be worn on the child's body, said child finder comprising:

transmitter means for sending a monitoring signal to a receiver means for receiving said monitoring signal, said receiver means being typically positionable at a location remote from said transmitter means, said transmitter means being concealingly retained within said watch;

switch means for effecting an operation of said transmitter means, said switch means being concealingly mounted on said watch, said switch means being mounted to protrude exteriorly from a body portion of said watch and is reciprocally operable to activate said transmitter means, said switch means being formed in a cylindrical configuration and fabricated of electrically conductive material; and said transmitter means being in a deactivated mode when said switch means is in an outward protruding position relative to said body portion of said watch and is in an activated mode when said switch means is depressed so as to move inwardly into said body portion of said watch, the wearing of said watch causing said switch means to move inwardly into said body portion of said watch, thereby activating said transmitter means.

2. A child finder constructed as an article of jewelry to be worn on the child's body said child finder comprising:

transmitter means for sending a monitoring signal to a receiver means for receiving said monitoring signal, said receiver means being typically positionable at a location remote from said transmitter means, said transmitter means being concealingly retained within said article of jewelry;

switch means for effecting an operation of said transmitter means, said switch means being concealingly mounted on said article of jewelry, said switch means being mounted to protrude exteriorly from a body portion of said article of jewelry and is reciprocally operable to activate said transmitter means; and said transmitter means being in a deactivated mode when said switch means is in an outward protruding position relative to said body portion of said article of jewelry and is in an activated mode when said switch means is depressed so as to move inwardly into said body portion of said article of jewelry, the wearing of said article of jewelry causing said switch means to move inwardly into said body portion of said article of jewelry, thereby activating said transmitter means, said switch means being spring biasedly mounted in said body portion of said article of jewelry through the use of a compression spring positioned between an inner and outer casing of said body portion of said article of jewelry.

3. The child finder constructed as an article of jewelry to be worn on the child's body as described in claim 2 wherein said article of jewelry is a watch.

* * * * *